US005346055A

United States Patent [19]

Zierpka

[11] Patent Number: 5,346,055

[45] Date of Patent: Sep. 13, 1994

[54] MACHINERY FOR DISCONTINUOUSLY FORWARDING MATERIAL OR WORK PAST OR THROUGH DISCONTINUOUSLY OPERATING TOOLS

[76] Inventor: Günter Zierpka, Elfenweg 2, D-7500 Karlsruhe 51, Fed. Rep. of Germany

[21] Appl. No.: 87,576

[22] Filed: Jul. 2, 1993

[30] Foreign Application Priority Data

Jul. 16, 1992 [DE] Fed. Rep. of Germany ..... 4223340

[51] Int. Cl.[5] ..... B65G 25/00

[52] U.S. Cl. ..... 198/621; 72/405

[58] Field of Search ..... 198/468.2, 468.6, 621, 198/774.1; 414/750, 751; 72/405, 421

[56] References Cited

U.S. PATENT DOCUMENTS 3,620,381 11/1971 McCaughey ..... 198/621
3,875,808 4/1975 Okamoto et al. ..... 414/750
3,910,422 10/1975 Zierpka ..... 198/621

*Primary Examiner*—Joseph E. Valenza
*Attorney, Agent, or Firm*—Max Fogiel

[57] ABSTRACT

Machinery for discontinuously forwarding material or work past or through discontinuously operating tools, presses for example. Two separated work-holder bars parallel the forwarding stream. The bars move upstream and downstream together subject to a cam. The cam rotates around an axis paralleling the stream. The motion of the cam is transmitted to the bars by a follower and by a transmission. The transmission engages guides that guide the bars. The bars are accordingly discontinuously shifted in at least one direction essentially cross-stream. The follower is mounted on a rocker. The rocker pivots around a pivot secured stationary to the machinery above and more or less paralleling the axis of the cam. The follower is forced by a spring against the circumference of the cam. The transmission is a linkage including a reversing lever. A thruster is articulated to the rocker at a point remote from the pivot. The thruster pivots the reversing lever around another pivot. The second pivot is also secured stationary to the machinery and parallels the pivot that the cam pivots around. The cross-stream motions of the work-holder bars are derived from the reversing lever.

21 Claims, 3 Drawing Sheets

MACHINERY FOR DISCONTINUOUSLY FORWARDING MATERIAL OR WORK PAST OR THROUGH DISCONTINUOUSLY OPERATING TOOLS

BACKGROUND OF THE INVENTION

The present invention concerns machinery for discontinuously forwarding material or work past or through discontinuously operating tools, presses for example. Two separated workholder bars parallel the forwarding stream. The bars move upstream and downstream together subject to a cam. The cam rotates around an axis paralleling the stream. The motion of the cam is transmitted to the bars by a follower and by a transmission that engages guides that guide the bars. The bars are accordingly discontinuously shifted in at least one direction essentially cross-stream.

Machinery of this type and for this purpose is known from German OS 2 206 407. The work-holder bars move upstream and downstream together and toward and away from each other cross-stream. Each motion is generated by a different cam. The cams are mounted tight on the same shaft, which extends parallel with and below the work-holder bars.

The upstream and downstream motions of the work-holder bars in this machinery are derived from an axial cam and transmitted to cross-stream work holder-bar guides by way of a thruster. The thruster and guides move stream-parallel. The cam generating the toward-and-away motion that opens and closes the work holder on the other hand is a radial cam. The transmission for the cross-stream drive mechanism comprises two cogwheels positioned immediately above the cam. Each cogwheel meshes with the other and with a rack that extends across the gripper bars. A follower that operates in conjunction with the cam rests against the circumference of the engaging cogwheels.

This known forwarding machinery is simple and reliable and has been well proven. It does have drawbacks, however. It is noisy, and the cogs wear out after a while, which leads to even more noise along with imprecision in the motions of the work-holder bars.

SUMMARY OF THE INVENTION

The present invention counters these insufficiencies in work-forwarding machinery by providing that the follower is mounted on a rocker. The rocker pivots on a pivot secured stationary to the machinery above and more or less paralleling the axis of the cam. The follower is forced by a spring against the circumference of the cam. The transmission is a linkage including a reversing lever. A thruster is articulated to the rocker at a point remote from the pivot. The thruster pivots the reversing lever around a pivot that is also secured stationary to the machinery and parallels the pivot that the cam pivots around. The cross-stream motions of the work-holder bars are derived from the reversing lever.

The present invention accordingly uses a follower mounted on a rocker operating in conjunction with a linkage by way of a thruster as a transmission instead of the cogwheels employed in the known machinery, obtaining a practically non-wearing but still non-play transmission of the motions derived from the cam.

The reversing lever in one sensible embodiment of the present invention comprises at least two arms. One arm extends away from the pivot in one direction. One end of the thruster is articulated to it and the other end to the rocker. A link that transmits the motion to at least one of the work-holder bars is articulated to the other arm.

When it is necessary for the work-holder bars to move up and down together while moving cross-stream, the other end of the link that is articulated at one end to one of the reversing-lever arms in one sensible embodiment engages a lifting frame. The work holder-bar guides are mounted on the lifting frame. The reversing lever will as it pivots accordingly move the lifting frame and consequently the work-holder bars up and down.

The linkage that converts the motion derived from the cam into an up-and-down motion of both work-holder bars together can also include another reversing lever. This reversing lever is pivoted around a pivot secured stationary to the machinery by a link articulated to one arm of each reversing lever and is articulated to and operates in conjunction with the lifting frame that travels up and down by a link articulated to the other arm of the reversing lever.

Such an up-and-down drive mechanism for raising and lowering the work-holder bars will distribute load better than one with only one reversing lever. Tilting and jamming can be effectively prevented in particular when in accordance with another embodiment of the invention the two reversing levers that are interconnected and operate in conjunction by way of a link are positioned more or less symmetrically on opposite sides of the rocker.

It has also been demonstrated practical for the follower to be forced against the circumference of the cam by at least one pneumatic cylinder that engages the lifting frame. One pneumatic cylinder that engages the lifting frame can of course also be positioned more or less symmetrically on opposite sides of the rocker.

The reversing-lever arms in another significant embodiment of the invention extend away from its pivot in opposite directions, and a link articulated to each arm is articulated directly to one of the cross-stream work holder-bar guides.

The resulting drive mechanism will move the rods toward and away from each other to open and close the work holder more or less synchronized.

It has also been demonstrated practical with such a cross-stream drive mechanism for the follower to be forced against the circumference of the cam by a pneumatic cylinder that directly engages the rocker.

The pneumatic cylinders that force the followers against their associated cams can be pressurized at either face of the piston and accordingly act in reverse. Pneumatic cylinders of this type particularly facilitate adapting the machinery to various conditions.

Whereas the stroke traveled by the work-holder bars perpendicular to their length in the machinery hereintofore described as prior art is invariable, the distance between the point where the thruster is articulated to the rocker and the pivot secured stationary to the machinery that the rocker pivots around can in another embodiment of the invention be varied to adjust the cross-stream and up-and-down strokes traveled by the work-holder bars to various conditions.

The rocker in one simple advanced version has bores distributed at various distances from the pivot secured stationary to the machinery, allowing the thruster to be articulated at various points. In the interest of a more precise geometry it has been demonstrated practical in this embodiment for the bores distributed at various distances from the pivot to be distributed along the arc of a circle. The point where the other end of the thruster is articulated to the reversing lever is at the center.

The thruster in another advanced version of this embodiment is articulated to a traveler. The traveler is mounted on the rocker and can be adjusted radially in relation to the pivot. The traveler can slide back and forth in a channel that extends radially out from the pivot and accordingly affords continuous adjustment of the thruster's point of articulation and hence of the stroke traveled by the workholder bars.

Continuous adjustment is particularly easy when in accordance with another advanced version the traveler rotates on a threaded shaft that extends out radially from the rocker pivot.

The length of the thruster that allows the rocker to operate in conjunction with the reversing lever in another practical advanced version is variable. The length can in particular be varied if the thruster comprises two sections. One section is articulated to the rocker and the other to one arm of the reversing lever. The sections are interconnected by a threaded shaft. The shaft screws into threaded bores in the facing ends of each section.

The hereintofore described machinery is characterized by an at least extensively straight transfer of force from the follower to the holder-bar guides by way of the rocker and transmission linkage. It is of advantage in this embodiment for the follower, the cam, and the rocker to operate in a single plane. Such an arrangement will eliminate moments deriving from lateral displacements. The same is valid for the links in the transmission, which extend within or symmetrical to the plane of the cam, the follower, and the rocker and are articulated to the rocker and/or to each other within or symmetrical to that plane.

Forwarding machinery with a cross-stream drive mechanism for opening and closing a work holder and an up-and-down mechanism for raising and lowering the two work-holder bars simultaneously will now be specified with reference to the drawing, wherein

DESCRIPTION OF THE PREFERRED EMBODIMENTS

Figure 1:
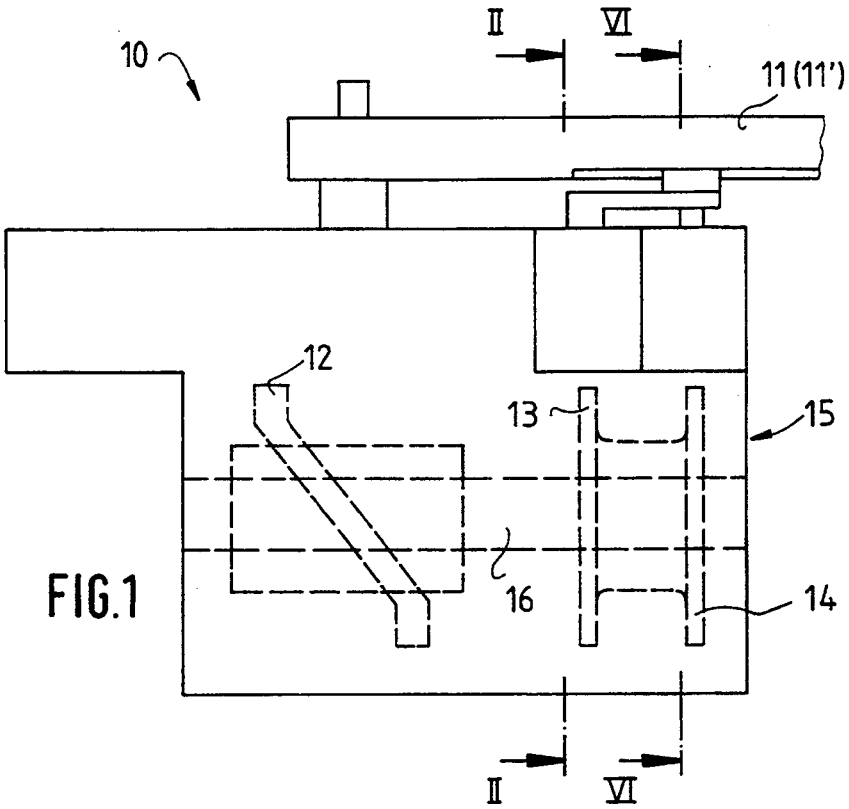
FIG. 1 is a side view of forwarding machinery with two work-holder bars extending downstream.

The drawing illustrates machinery 10 for forwarding work from an upstream to a downstream processing point. Machinery of this type is employed in particular to advance the work from one step of an operation to the next in molding or stamping or to integrate the presses into a single operation.

The forwarding machinery 10 illustrated from the side in FIG. 1 includes, first, a work holder with bars 11 and 11' and, second, radial cams 12, 13, and 14. Cams 12, 13, and 14 move the bars upstream and downstream, toward and away from each other, and vertical up and down. The cams are all mounted tight on a shaft 16 extending downstream inside a housing 15 below the work holder. The shaft and accordingly the cams are rotated in synchronization with a press by a con, non motor.

Bars 11 and 11' are both moved together upstream and downstream, stream-parallel that is, by a transmission subject to cam 12 that will not be further specified herein. Cam 13 moves the bars toward and away from each other cross-stream and essentially synchronized to open and close the holder. Cam 14 moves them up and down simultaneously.

Figure 2:
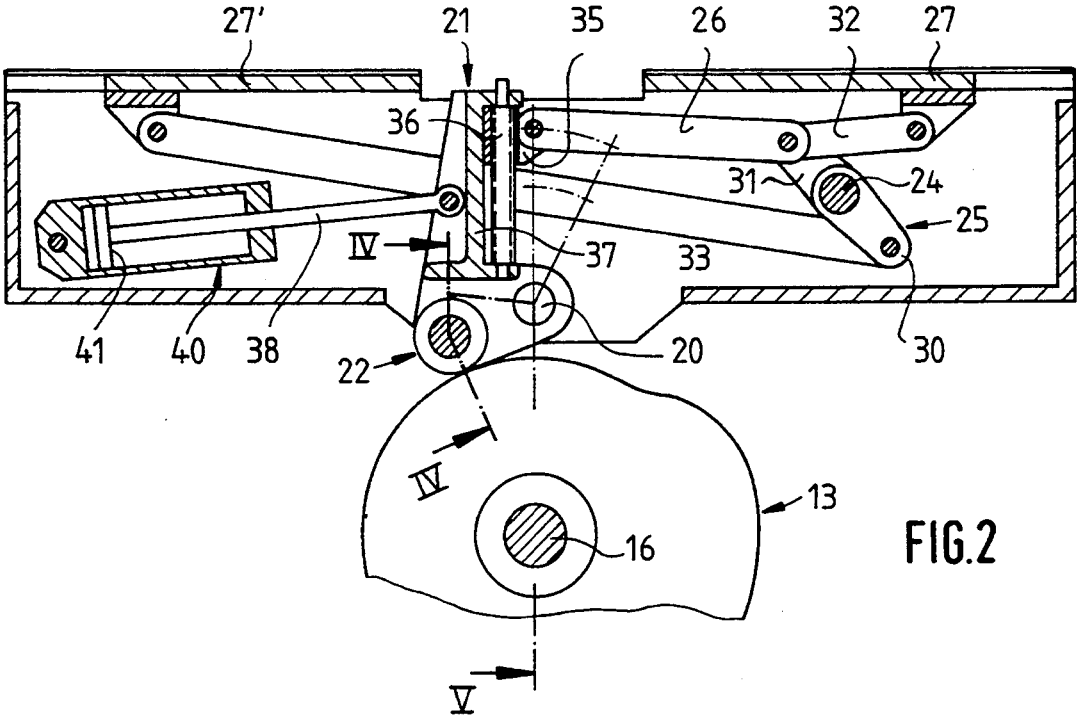
FIG. 2 is a section through the machinery along the line II—II in FIG. 1 illustrating a cross-stream drive mechanism subject to a cam and opening and closing the work holder.

FIG. 2 illustrates without the work holder itself the cross-stream mechanism that opens and closes it in synchronization. The mechanism comprises the aforesaid cam 13 mounted tight on shaft 16, a rocker 21 that pivots around a stationary pivot 20 and operates in conjunction with a follower 22 resting against the circumference of the cam, and finally a transmission comprising several links. A two-part reversing lever 25 pivots around a stationary pivot 24 paralleling shaft 16 and is connected to rocker 21 by a thruster 26.

Both the cam 13 mounted tight on shaft 16 and the rocker 21 that pivots above it around pivot 20 are positioned symmetrical to bars 11 and 11'. The bars themselves are accommodated in unillustrated stream-parallel work holder-bar guides mounted on cross-stream work holder-bar guides 27 and 27'.

The transmission's reversing lever 25 generates the motions in bars 11 and 11' that open and close the work holder. Lever 25 itself comprises two arms 30 and 31 extending out on each side of pivot 24. One end of thruster 26 is articulated to rocker 21 and its other end to arm 31 and to another link 32. Link 32 is articulated directly to cross-stream bar guide 27. Arm 30 is connected by another link 33 to cross-stream bar guide 27'. Shaft 16 extends with cam 13 mounted on it more or less equidistant between cross-stream bar guides 27 and 27'. Link 33 is articulated at one end to cross-stream bar guide 27' and at the other to the arm 30 in reversing lever 25. Link 33 comprises two parallel shafts for reasons that will be specified hereinafter and extends past rocker 21 on each side.

Thruster 26 is articulated to the arm 31 in reversing lever 25 and pivots it around pivot 24. The end of thruster 26 remote from reversing lever 25 is articulated to a traveler 35. Traveler 35 travels up and down a threaded shaft 36. Threaded shaft 36 rotates on rocker 21 and extends more or less radially away from the rocker's pivot 20. The point of articulation of thruster 26 to rocker 21 can accordingly be continuously displaced along the rocker's channel 34. It is accordingly possible to vary the distance between the point of articulation of thruster 26 to rocker 21 and the rocker's pivot 20. Varying this distance will in turn adjust the stroke transmitted by the thruster to reversing lever 25 and hence facilitate limiting the distance traveled toward and away from each other by work-holder bars 11 and 11' to comply with different conditions.

Also engaging rocker 21 is a pneumatic piston-and-cylinder mechanism. A piston 41 travels back and forth inside a cylinder 40 and can be subjected to gas on either side. Connected to the piston is a piston rod 38 that articulates to the rocker at a point remote from its pivot 20. Applying pressure to the side of piston 41 that faces rocker 21 will accordingly force follower 22 against the circumference of cam 13.

Figure 3:
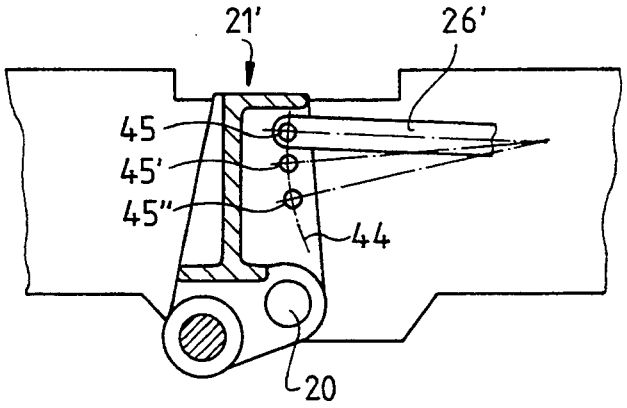
FIG. 3 is a detail of a different version of part of the mechanism illustrated in FIG. 2.

The point of articulation between thruster 26 to rocker 21 need not be continuously displaceable. One alternative is exhibited by the rocker 21' in the embodiment illustrated in FIG. 3. It has a series of holes 45, 45', and 45'' distributed along an arc 44 of a circle. Thruster 26' is articulated to arm 31 of reversing lever 25 at the midpoint of the arc. Thruster 26 can accordingly be articulated to rocker 21 at various distances from pivot 20', providing discontinuous adjustment of the bars' movements toward and away from each other.

Figure 6:
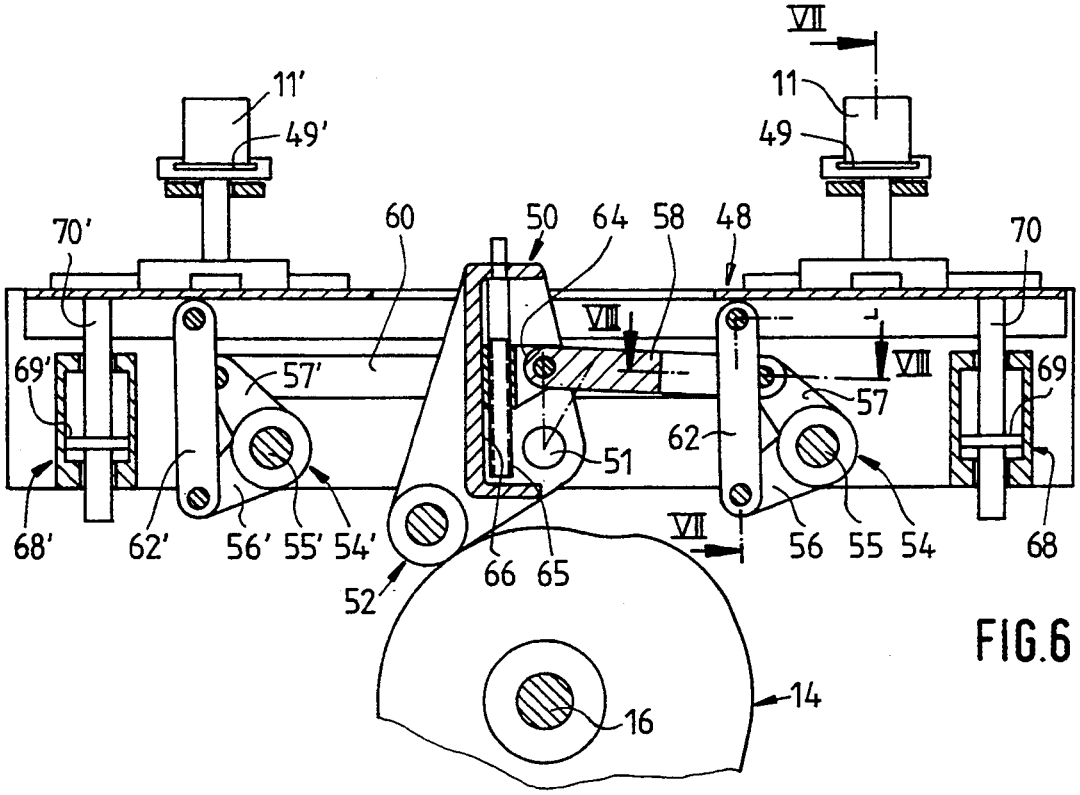
FIG. 6 is a sectional view taken along line VI—VI in FIG. 1 and shows a mechanism for raising and lowering the work-holder bars.

FIG. 6 illustrates a mechanism for raising and lowering work-holder bars 11 and 11' together. A lifting frame 48 extends cross-stream. Stream-parallel work holder-bar guides 49 and 49' slide back and forth cross-stream on lifting frame 48. Up-and-down drive mechanism, like the cross-stream mechanism specified with reference to FIG. 2 in particular, includes a cam, a cam follower, and a rocker. Cam 14 is mounted tight on shaft 16. Rocker 50 is mounted immediately above the cam on a pivot 51 that parallels the shaft. Follower 52 rests against the circumference of cam 14.

The up-and-down drive mechanism also includes a transmission comprising reversing levers 54 and 54', lever arms 56, 56', 57, and 57', a thruster 58, and links 60, 62, and 62'. Reversing levers 54 and 54' are mounted one on each side of rocker 50 more or less under stream-parallel work holder-bar guides 49 and 49'. The levers pivot around stationary pivots 55 and 55' that parallel rocker pivot 5. The arms 56 and 57 that comprise reversing lever 54 extend out from pivot 55 on each side. Similarly, the arms 56' and 57' that comprise reversing lever 54' extend out from pivot 55' on each side. Rocker 50 is connected to and operates in conjunction with reversing lever 54 by way of thruster 58. One end of thruster 58 is articulated to rocker 50 and the other end to the arm 57 of reversing lever 54. Reversing lever 54 is also connected to and operates in conjunction with reversing lever 54' by way of link 60. One end of link 60 is connected to lever arm 57 and the other to lever arm 57'. Link 60, like the link 33 in the cross-stream mechanism, comprises two parallel shafts that extend past rocker 50 one on each side. The other arm 56 of reversing lever 54 is articulated to a link 62. Link 62 is articulated to lifting frame 48. The other arm 56' of reversing lever 54' is similarly articulated to a link 62'. Link 62' is also articulated to lifting frame 48. The two arms are accordingly connected to and operate in conjunction with each other by way of links 62 and 62' and lifting frame 48. When rocker 50 pivots reversing lever 54, consequently, lifting frame 48 will move up and down with the work- holder bar guides mounted on it.

One end of the thruster 58 illustrated in FIG. 6 is, again as in the cross-stream mechanism, is articulated to a traveler 64. Traveler 64 travels up and down a threaded shaft 65. Threaded shaft 65 rotates on rocker 50. It is accordingly possible to continuously displace the traveler in a channel more or less radially to rocker pivot 51 and adjust the up-and-down motion of the work-holder bars to comply with different conditions.

The up-and-down drive mechanism, finally, is powered by two pneumatic piston-and-cylinder mechanisms. These mechanisms are positioned on each side of rocker 50 and somewhat beyond reversing levers 54 and 54'. Cylinders 68 and 68' are secured stationary to the overall machinery. A piston 69 slides back and forth inside cylinder 68 and another piston 69' slides back and forth inside cylinder 68'. Pneumatic pressure can be applied to either side of both pistons. Pistons 69 and 69' are secured to lifting frame 48 by piston rods 70 and 70' respectively. The positions of the piston-and-cylinder mechanisms ensure that piston rods 70 and 70' will engage lifting frame 48 essentially symmetrically. One characteristic of the forwarding machinery in accordance with the present invention is that the transmission that transmits motion from the cams in order to both open and close and raise and lower the work holder operates practically without play. Another characteristic is that the force applied by the cams to engage the various transmission components with both cross-stream work holder-bar guides 27 and 27' and lifting frame 48 travels in a straight line and accordingly symmetrically from one component to the next.

Figure 4:
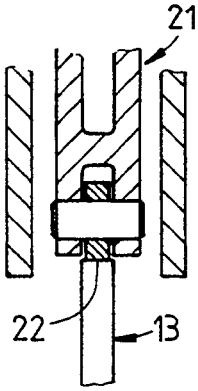
FIG. 4 is a section through the machinery along the line IV—IV in FIG. 2

The cam follower in the hereintofore described prior art was mounted on and parallel to a cogwheel. The cam followers 22 and 52 in the machinery in accordance with the present invention on the other hand are mounted in forked accommodations in rockers 21 and 50. Cam 13, follower 22, and rocker 21 are accordingly, as will be evident from FIG. 4, all in the same plane. Consequently, when follower 22 rotates around the axis constituted by shaft 16, force will be applied to rocker 21 only around pivot 20 and not at an angle thereto.

Figure 5:
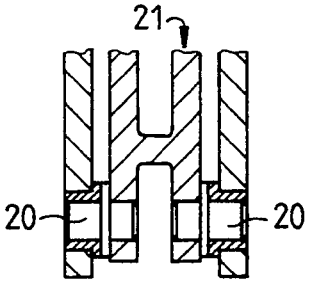
FIG. 5 is a sectional view taken along line V—V in FIG. 2.

The pivot 20 that rocker 21 pivots around is mounted stationary on the overall machinery. As will be evident from FIG. 5, pivot 20 extends through both prongs of the forked area of rocker 21, providing a bearing symmetrical to both sides of the plane the rocker operates in.

Figure 7:
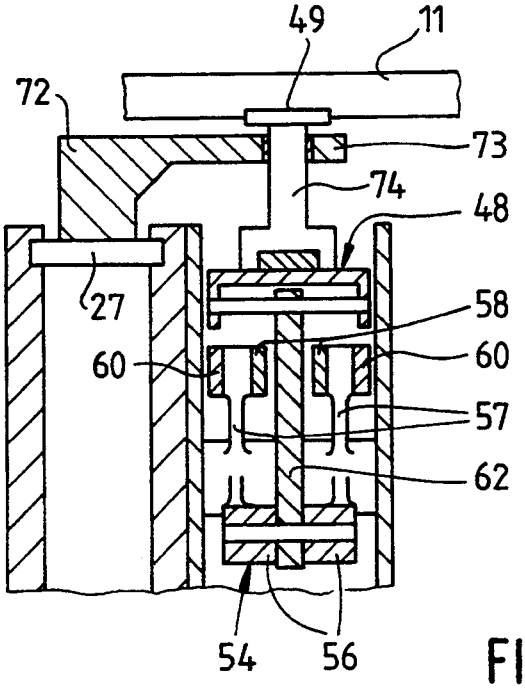
FIG. 7 is a sectional view taken along line VII—VII in FIG. 6.
Figure 8:
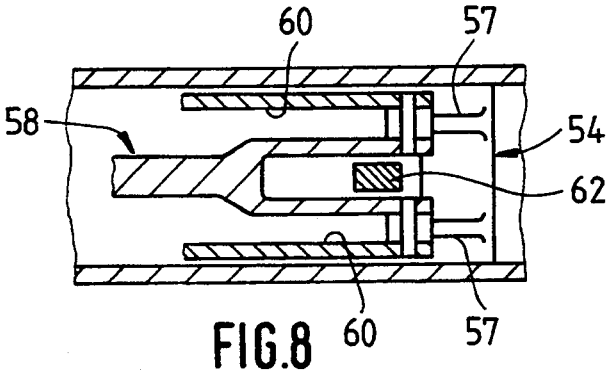
FIG. 8 is a sectional view taken along line VIII—VIII in FIG. 6.

The same principle applies to the transmission of motion from the rocker to the reversing lever and from the reversing lever to the work holder-bar guides or lifting frame. The situation will now be specified with reference to the up-and-down drive mechanism as illustrated in FIGS. 7 and 8. The cross-stream mechanism is analogous.

As will be evident from FIG. 8, arm 57 of reversing lever 54 comprises two parallel shafts extending toward stationary pivot 55. The end of thruster 58 that is articulated thereto is forked. One end of link 62 is articulated to reversing-lever arm 55 and the other end to lifting frame 48. Link 62 also extends through the fork on thruster 58.

As hereintofore specified, the link 60 that connects reversing levers 54 and 54' and is articulated to reversing-lever arms 57 and 57' comprises two parallel shafts, one of which extends past rocker 50 on each side. This situation will also be evident from FIG. 8, whereas FIG. 6 illustrates only the shaft that passes behind the rocker as viewed.

Both FIG. 7 and FIG. 8 illustrate the various articulations in this portion of the assembly. Thruster 58 is articulated symmetrical to the width of reversing lever 54 with its forked end on lever arm 57. Both shafts of link 60 are articulated to lever arm 57. Link 62, which operates in conjunction with lifting frame 48, is articulated at its midpoint to the other arm 56 of reversing lever 54. The vertical motions derived from the pivoting of reversing lever 54 are accordingly transmitted to the center of lifting frame 48 by way of link 62. The situation is similar with respect to reversing lever 54'.

FIG. 7 also illustrates how the cross-stream drive mechanism operates in conjunction with the up-and-down drive mechanism. The assembly that includes the cross-stream work holder-bar guides is in direct contact with the assembly that includes the up-and-down drive mechanism. The figure illustrates only one cross-streamwork holder-bar guide 27. Mounted stationary on it is an angled guide component 72. One arm of component 72 projects out above lifting frame 48. A beam 74 extends through a vertical channel in the arm. Beam 74 supports stream-parallel work holder-bar guide 49. The situation with respect to the stream-parallel guide 49' that guides work-holder bar 11' is similar.

Figure 9:
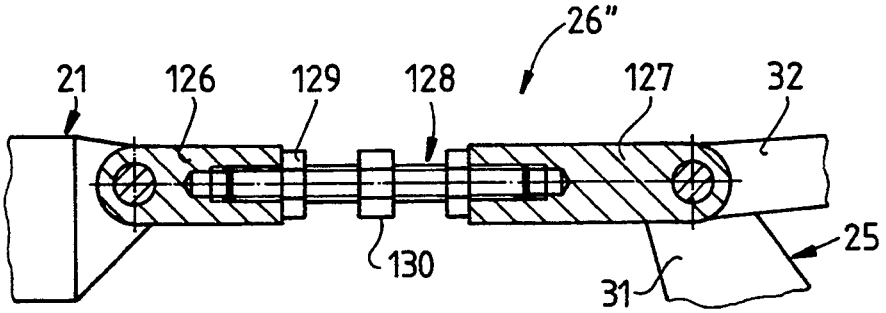
FIG. 9 is a sectional view and shows a variable-length thruster.

FIG. 9 illustrates a variable-length thruster 26'' comprising two connected sections 126 and 127. Section 126 is articulated to the traveler 35 on rocker 21. Section 127 is articulated to arm 31 of reversing lever 25. Section 126 is connected to section 127 by a threaded shaft 128 that screws into threaded bores in the facing ends of each section. The shaft is maintained at the illustrated length by an adjustable nut 129 that screws onto it and rests against end 126. Approximately half-way along threaded shaft 128 is a polygon 130 that provides purchase for a wrench to rotate the shaft and accordingly vary the length of thruster 26''.

I claim:

1. Machinery for discontinuously forwarding material or work past or through discontinuously operating tools, such as presses, comprising: two separated work-holder bars parallel to a forwarding stream; a cam with a circumference said bars moving upstream and downstream together subject to said cam, said cam rotating around an axis paralleling said stream; a cam follower, motion of said cam being transmitted to said bars by said follower and by a transmission engaging guides that guide said bars, said bars being accordingly discontinuously shifted in at least one direction essentially cross-stream; said follower being mounted on a rocker pivoting around a pivot secured stationary to the machinery above and substantially paralleling said axis of said cam; a spring forcing said follower against said circumference of said cam; said transmission being a linkage having a reversing lever; a thruster articulated to said rocker at a point remote from said pivot, said thruster pivoting said reversing lever around a pivot also secured stationary to the machinery and parallel to said pivot that said cam pivots around, cross-stream motions of said work-holder bars being derived from said reversing lever.

2. Machinery as defined in claim 1, wherein said reversing lever comprises at least two arms, one of said arms extending away from said pivot in one direction, one end of said thruster being articulated to said one arm and another end of said thruster being articulated to said rocker; and a link with one end transmitting motion to at least one of said work-holder bars and being articulated to the other one of said arms.

3. Machinery as defined in claim 2, wherein another end of said link is articulated to one of said reversing-lever arms at one end engaging a lifting frame, said work-holder bar guides being mounted on said lifting frame.

4. Machinery as defined in claim 3, wherein said linkage converts motion derived from said cam into an up-and-down motion of both work-holder bars together, said linkage having another reversing lever pivoted around another pivot secured stationary to the machinery by a link articulated to one arm of each reversing lever and articulated also to and operating in conjunction with said lifting frame by a link articulated to the other arm of said reversing lever, said lifting frame traveling up and down.

5. Machinery as defined in claim 6, including a link interconnecting said two reversing levers positioned substantially symmetrically on opposite sides of said rocker.

6. Machinery as defined in claim 3, including at least one pneumatic cylinder engaging said lifting frame and forcing said follower against the circumference of said cam.

7. Machinery as defined in claim 6, wherein said pneumatic cylinder engaging said lifting frame is positioned substantially symmetrically on opposite sides of said rocker.

8. Machinery as defined in claim 1, wherein said reversing-lever arms extend away from said pivot in opposite directions; and a link articulated to each arm and articulated directly to one of said cross-stream work-holder bar guides.

9. Machinery as defined in claim 8, including a pneumatic cylinder engaging directly said rocker and forcing said follower against the circumference of said cam.

10. Machinery as defined in claim 6, including pistons with two faces operating with said cylinders, either one of said piston faces can be pressurized to act in reverse.

11. Machinery as defined in claim 1, wherein a distance between a point where said thruster is articulated to said rocker and said pivot secured stationary to the machinery that said rocker pivots around can be varied.

12. Machinery as in claim 11, wherein said rocker has bores distributed at various distances from said pivot secured stationary to the machinery, so that said thruster can be articulated at various points.

13. Machinery as in claim 12, wherein said bores distributed at various distances from said pivot are distributed along an arc of a circle with a point where the other end of said thruster is articulated to said reversing lever at a center.

14. Machinery as in claim 11, including a traveler mounted on said rocker and adjustable radially in relation to said pivot, said thruster being articulated to said traveler.

15. Machinery as in claim 14, wherein said traveler slides back and forth in a channel extending radially out from said pivot in said rocker.

16. Machinery as defined in claim 14, wherein said traveler rotates on a threaded shaft extending out radially from said pivot that said rocker pivots around.

17. Machinery as defined in claim 1, wherein a length of said thruster allowing said rocker to operate in conjunction with said reversing lever is variable.

18. Machinery as defined in claim 17, wherein said thruster comprises two sections, one of said two sections being articulated to said rocker and the other one of said two sections being articulated to one arm of said reversing lever; a threaded shaft interconnecting said two and screwed sections into threaded bores in facing ends of each section.

19. Machinery as defined in claim 1, wherein a force is transferred at least extensively straight from said follower to said holder-bar guides through said rocker and transmission linkage.

20. Machinery as defined in claim 19, wherein said follower, said cam, and said rocker that said follower is mounted on operate in a single plane.

21. Machinery as defined in claim 20, wherein links in said transmission extend within or symmetrically to said plane of said cam, said follower, and said rocker are articulated to said rocker and to each other within or symmetrical to said plane.

* * * * *